United States Patent [19]

Barriac

[11] Patent Number: 4,801,031

[45] Date of Patent: Jan. 31, 1989

[54] TAMPER-INDICATING CLOSURES AND PACKAGES

[75] Inventor: Jacques J. Barriac, Toledo, Ohio

[73] Assignee: Owens-Illinois Closure Inc., Toledo, Ohio

[21] Appl. No.: 54,922

[22] Filed: May 28, 1987

[51] Int. Cl.[4] ..... B65D 41/34

[52] U.S. Cl. ..... 215/252

[58] Field of Search ..... 215/252

[56] References Cited

U.S. PATENT DOCUMENTS

| | | | |
|---|---|---|---|
| 3,199,703 | 8/1965 | Alexander | 215/252 |
| 3,484,012 | 12/1969 | White et al. | 215/252 |
| 4,470,513 | 9/1984 | Ostrowsky | 215/252 |
| 4,506,795 | 3/1985 | Herr | 215/252 |
| 4,546,892 | 10/1985 | Couput | 215/252 |
| 4,613,052 | 9/1986 | Gregory et al. | 215/252 |

*Primary Examiner*—Donald F. Norton

[57] ABSTRACT

A tamper-indicating closure and package and method of making comprising a one-piece molded closure of plastic which threads onto a container such that when the closure is unthreaded, a tamper-indicating band becomes separated from the lower end of the closure skirt. The tamper-indicating band is joined to the closure along a weakened frangible line. A flexible wall is formed within the band and extends axially toward the base of the closure. The wall has a free edge which has circumferentially flexible spaced flexible wall portions defining pleats or scallops that extend radially inwardly. When the closure is applied to the container, the circumferentially extending wall portions flex radially outwardly over the annular bead on the container and then radially inwardly beneath the annular bead. When the closure is unthreaded, the upper edges of the circumferentially spaced circumferential wall portions engage the underside of the bead and cause the band to sever along the weakened line. The closure is first formed with a portion which extends axially from the closure skirt and this portion is scored to form the weakened line, rolled to form an indentation defining a hinge, pleated to form the circumferentially spaced flexible wall portions and then folded inwardly about the hinge toward the base of the closure.

2 Claims, 6 Drawing Sheets

TAMPER-INDICATING CLOSURES AND PACKAGES

BACKGROUND AND SUMMARY OF THE INVENTION

It has heretofore been suggested that a tamper-indicating band be connected to a closure, the band having flexible portions that are deflected over an annular bead on the container and under the annular bead such that when the closure is unthreaded from the container, the flexible portions cause the band to be severed from the remainder of the closure indicating that the closure has been opened.

In U.S. Pat. Nos. 4,350,844 and 4,613,052, having a common assignee with the present application, there is disclosed and claimed a screw type cap of plastic with a tamper-indicating ring or band that is carried at the lower end of the skirt of the closure with frangible bridges forming the connection. The removal of the closure results in the indicating band being severed from the closure and the band is moved to a lower position on the neck and is presented from being returned to its, as applied, position. A container has a finish, below external threads which is formed with an inwardly and downwardly tapering side wall which leads to an abrupt, horizontal ledge such that when an indicating band is severed from a closure, on removal, the band falls below the ledge and cannot be returned. The closure is formed with internal threads in the skirt and at the bottom of the skirt a band or ring of about the same external diameter as the cap is formed with frangible bridges joining the band to the skirt. Within the indicating band, an inwardly extending flexible stop ring is formed integral with the indicating band. A particular finish on the container provides a pair of radial ledges which extend outwardly below the threads on the container neck. These ledges are vertically displaced relative to each other and are joined by an inwardly tapering wall which is adapted to form the surface on which the stop ring will be seated when the closure is applied. The stop ring prevents removal of the closure without the separation of the indicating band from the closure skirt.

In U.S. patent application Ser. No. 820,034, filed Jan. 21, 1986,and now U.S. Pat. No. 4,653,657, and having a common assignee with the present application, there is disclosed a tamper indicating package comprising a container having a neck with a threaded finish and a closure which includes a base wall and depending peripheral skirt having threads interengaging the threads of the container, and a tamper indicating band attached to the skirt by a plurality of circumferentially spaced frangible bridge members. The tamper indicating band includes a bead for engaging a complementary bead on the container, and a segmented annular flange extending axially upwardly and inwardly from the lower edge of the tamper indicating band towards the base wall of the closure. The annular flange has its free edge formed with a plurality of segments such that the stiffness of the flange is reduced. In addition, the leading end of each segment is cut to a 30° angle. These two features facilitate the application of the closure to the container.

In U.S. Pat. No. 4,546,892, there is disclosed a plastic tamper indicating closure which has an annular wall extending upwardly and inwardly and an annular bead or heel along the inner surface of the wall so that when the closure is applied to a container, the annular wall is interposed between the skirt of the closure and the finish of the container and the bead engages the underside of the ring on the finish to hold the closure in position.

In tamper indicating packages which utilize closures that have flexible portions associated with the tamper indicating band, when such closures are utilized with glass containers that have a wide range of tolerances, it is sometimes difficult to insure that proper clearance will be provided. In addition, because of the flexibility of the portions, there may be concern that somehow a user might attempt to deflect the portions in order to remove the closure and thereby defeat the purpose.

Accordingly, among the objectives of the present invention are to provide tamper indicating closure and package which will provide a tamper evident feature which is more reliable over a wider range of finish tolerances and which is much more difficult to defeat than certain plastic closures that have plural flexible portions that engage the container; which is easier to mold with high productivity; which requires low mold maintenance; and which is made by a novel method.

In accordance with the invention, a tamper-indicating closure and package and method of making comprising a one-piece molded closure of plastic which threads onto a container such that when the closure is unthreaded, a tamper-indicating band becomes separated from the lower end of the closure skirt. The tamper-indicating band is joined to the closure along a weakened frangible line. A flexible wall is formed within the band and extends axially toward the base of the closure. The wall has a free edge which has circumferentially flexible spaced flexible wall portions defining pleats or scallops that extend radially inwardly. When the closure is applied to the container, the circumferentially extending wall portions flex radially outwardly over the annular bead on the container and then radially inwardly beneath the annular bead. When the closure is unthreaded, the upper edges of the circumferentially spaced circumferential wall portions engage the underside of the bead and cause the band to sever along the weakened line. The closure is first formed with a portion which extends axially from the closure skirt and this portion is scored to form the weakened line, rolled to form an indentation defining a hinge, pleated to form the circumferentially spaced flexible wall portions and then folded inwardly about the hinge toward the base of the closure.

DESCRIPTION

Figure 1:
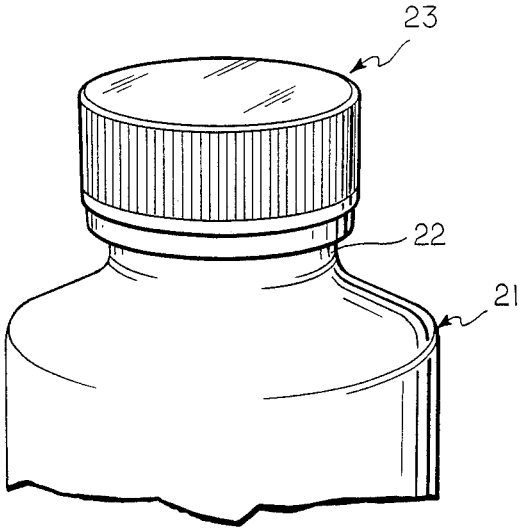
FIG. 1 is a fragmentary perspective view of a tamper indicating package embodying the invention.

Referring to FIG. 1, the tamper indicating package embodying the invention comprises a glass or plastic container 21 having a finish or neck 22 and a closure 23 formed of a thermoplastic material, such as polypropylene or high density polyethylene, molded as a single unit and comprising a generally disk-shaped base 24 and a cylindrical depending skirt 25. The inner surface of the skirt 25 is formed with threads 26 which are adapted to engage complementary threads 27 on the finish 22 (FIG. 7).

Figure 4:
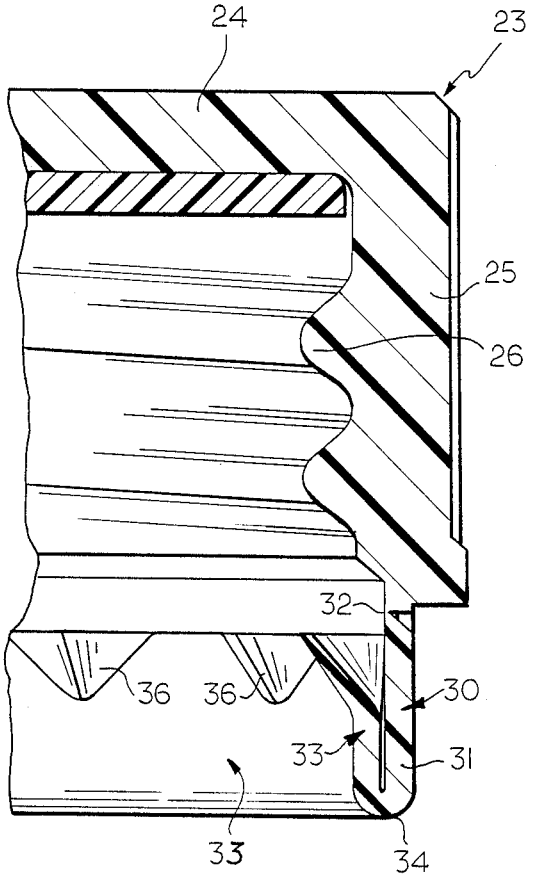
FIG. 4 is a fragmentary sectional view showing the closure after it has been finally formed for application to a container.

Referring to FIG. 4, the closure 23 includes a tamper-indicating band 30 has a first portion 31 joined to the lower edge of skirt 25 by a weakened line 32 and a second portion 33 joined by a portion 34 to first portion 31. The weakened line 32 may be formed during the molding of the closure or after molding as by scoring. The weakened line 32 may comprise a continuous thin wall or separate bridges. Second portion 33 defines a flexible annular wall extending axially from the lower edge of the first portion 31 axially toward the base 24 of closure 23. The free edge of wall 33 is formed with a plurality of circumferentially spaced flexible wall portions 33 defining pleats or scallops that extend radially inwardly from the remainder 35 of wall 33 from a point intermediate the connection portion 34 and the free edge and defining an undulating free edge. The portions 36 preferably are generally triangular when viewed in elevation.

Figure 7:
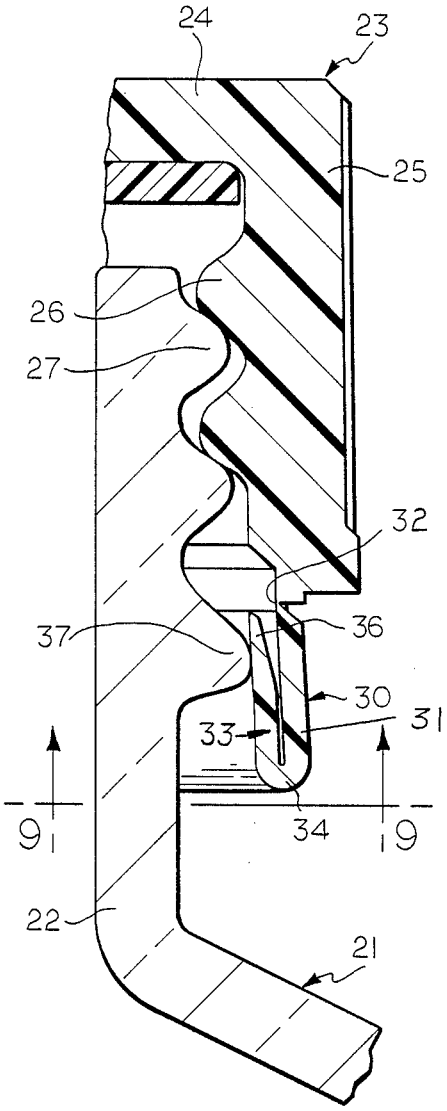
FIG. 7 is a fragmentary vertical sectional view showing the closure being applied to a container.
Figure 8:
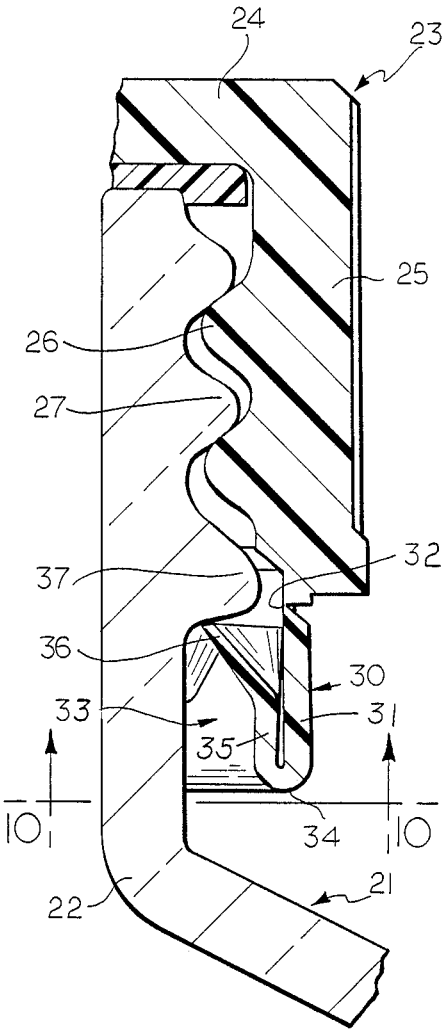
FIG. 8 is a fragmentary vertical sectional view showing the closure after it has been applied to a container.
Figure 9:
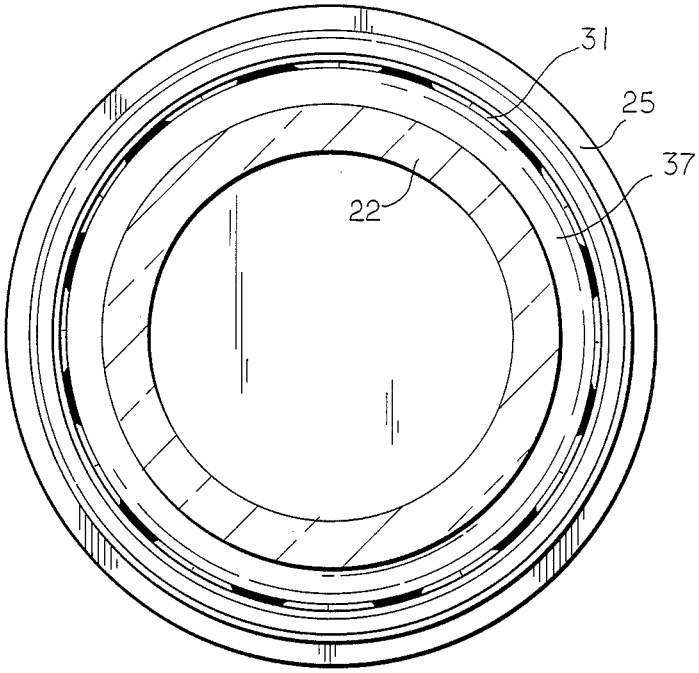
FIG. 9 is a sectional view of the closure and container taken along the line 9—9 in FIG. 7.
Figure 10:
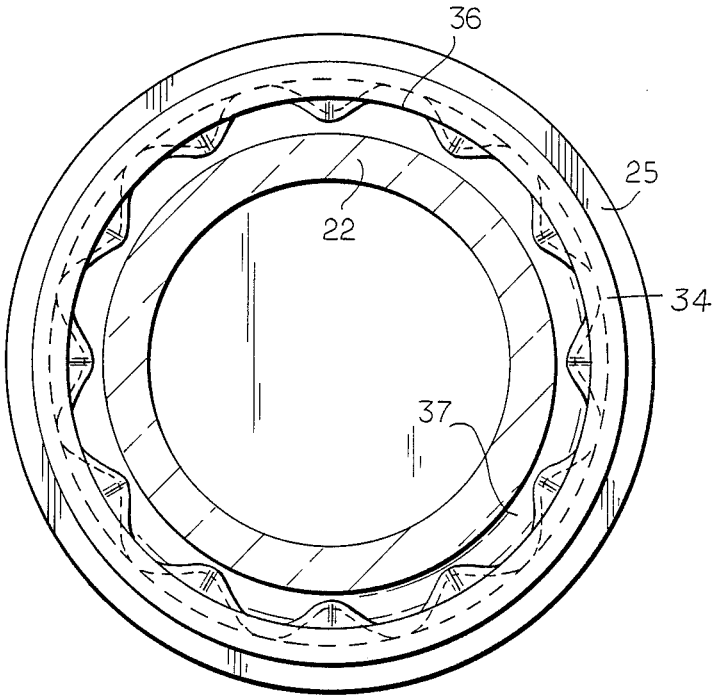
FIG. 10 is a sectional view of the closure and container taken along the line 10—10 in FIG. 8.

When the closure is applied as shown in FIGS. 7 and 9, the flexible portions 36 are deformed and deflect radially outwardly over an annular bead 37 on the finish 22 of the container 21. As the closure 23 is threaded on the container, the flexible wall portions 36 pass over the bead 37 and flex radially inwardly beneath the bead 37.

Figure 11:
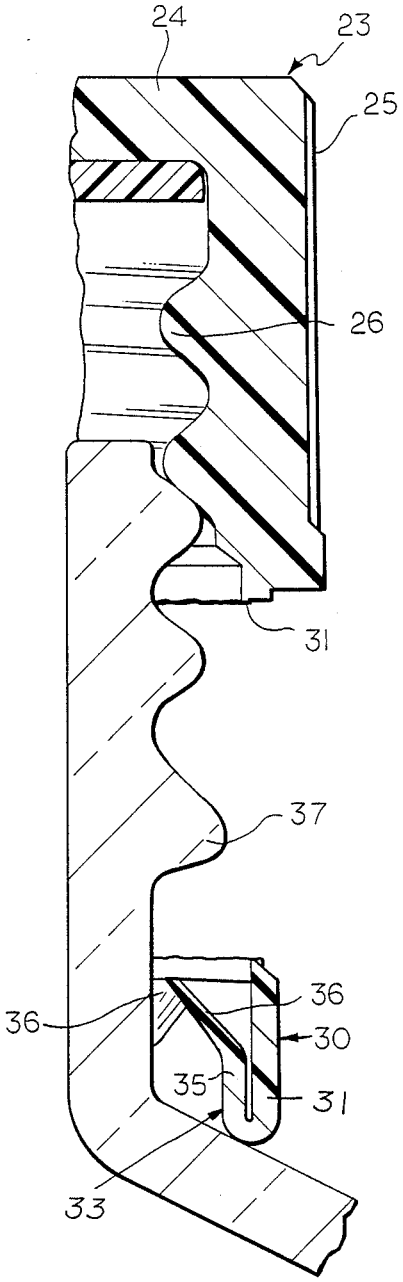
FIG. 11 is a vertical sectional view showing the container and closure as the closure is being removed and the tamper indicating band has been severed.
Figure 12:
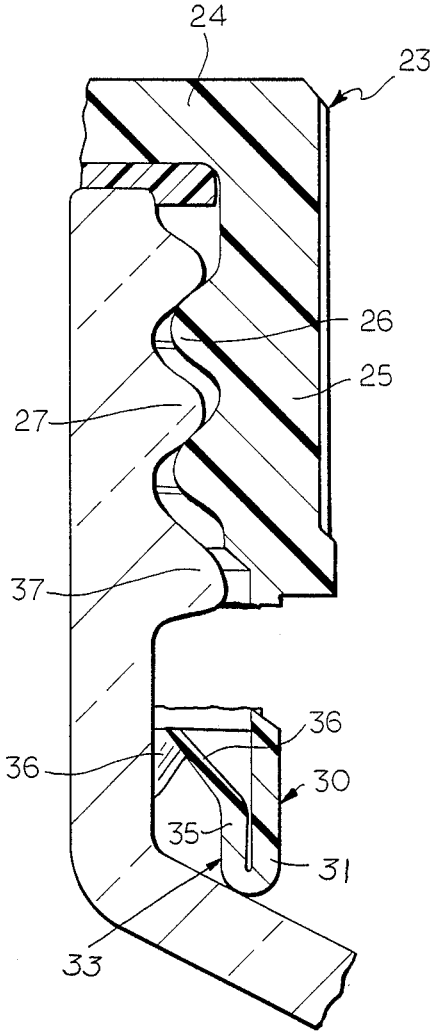
FIG. 12 is a fragmentary vertical sectional view showing the closure, band and container when the closure is re-applied.

Referring to FIGS. 11 and 12, when the closure 23 is unthreaded, the engagement of the free edges of the flexible wall portions 36 with the bead 37 causes the band 30 to be severed from the skirt 25 along weakened line 32 and the band falls downwardly away onto the neck 22 of the container 21 as shown in FIG. 12.

Figure 2:
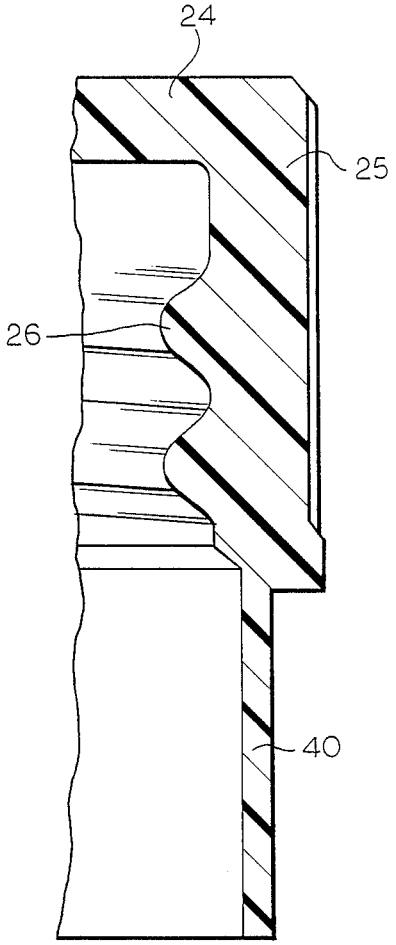
FIG. 2 is a fragmentary vertical sectional view through a closure embodying the invention after it has been molded.
Figure 3:
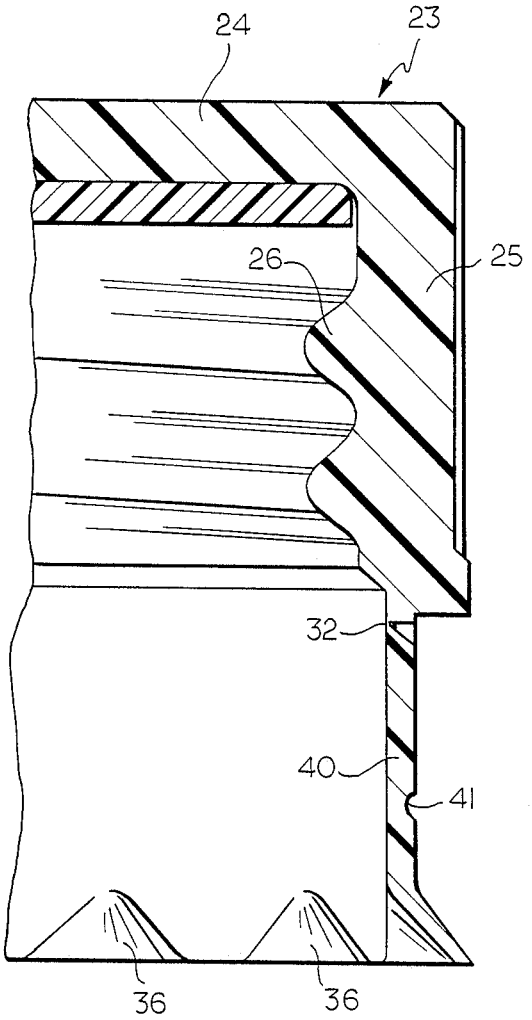
FIG. 3 is a fragmentary sectional view similar to FIG. 2 showing the closure partially formed.
Figure 5:
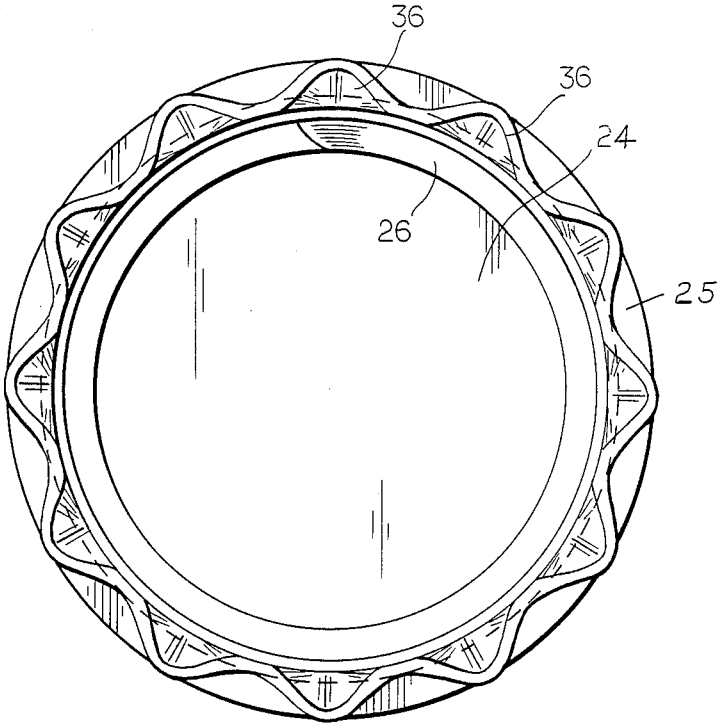
FIG. 5 is a bottom plan view of the partially formed closure in FIG. 3.
Figure 6:
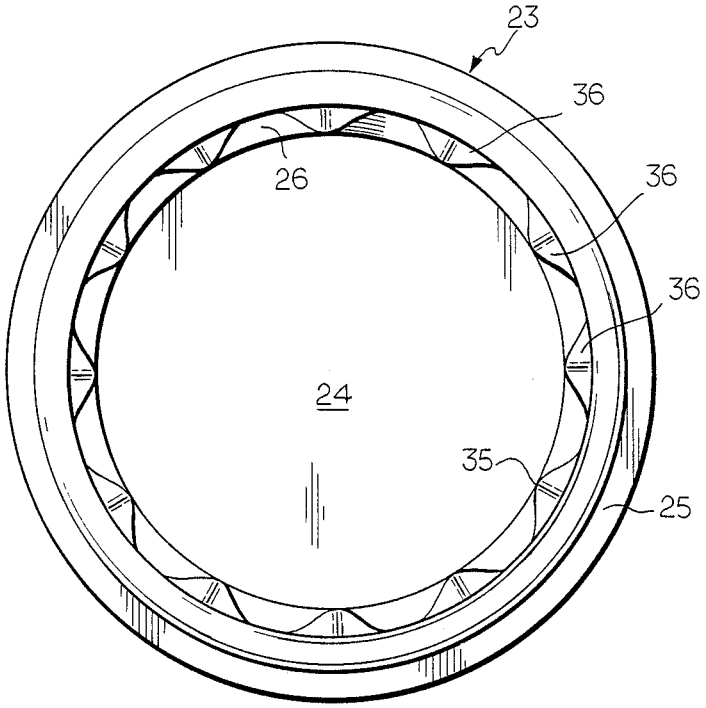
FIG. 6 is a bottom plan view of the finally formed closure shown in FIG. 4.

As molded, a wall 40 extends axially away from the skirt 25 (FIG. 2). Referring to FIGS. 3 and 5, if the wall 40 is not molded with a weakened line 32 such as bridges, after molding, the wall is scored to form a weakened line 32. The wall 40 is also formed with an external annular indentation 41 to form the connection portion 34 and formed with a plurality of flexible wall portions 36 which extend radially inwardly defining pleats or scallops along the free edge. The wall 30 is then folded along the indentation 41 to define the wall portion 33 which extends along the internal surface of the portion 31 with the flexible wall portions 36 extending radially inwardly (FIGS. 4 and 6). The free edge thereby faces upwardly toward the base wall 24.

It can thus be seen that there has been provided a closure which will accommodate wide tolerances and which can not be readily defeated. Such accommodation is especially useful where the container is made of glass.

I claim:

1. A tamper-indicating closure comprising a one-piece molded closure of plastic having a base wall and a peripheral skirt, said skirt having means thereon adapted to interengage securing means on a container, a tamper-indicating band on said closure having a first portion joined to the closure along a weakened frangible line and having an edge spaced from the weakened line, an integral second portion wall joined to the edge by an integral annular connecting portion on said band extending axially toward the base of the closure along the inner surface of said first portion of said band, said wall being joined to said band and spaced radially inwardly from said first portion, said wall having a free edge, said wall having circumferentially spaced flexible wall portions along said free edge extending radially inwardly, each said flexible wall portion comprising a pleat which extends radially inwardly from the remainder of the wall from a point intermediate the connecting portion and the free edge and defining an undulating free edge such that when the closure is applied to the container, the circumferentially spaced wall portions flex radially outwardly relative to the remainder of the wall over an annular bead on said container and then radially inwardly relative to the remainder of the wall beneath the bead on a container, and when the closure is removed, the upper edges of the circumferentially spaced wall portions engage the underside of said bead on a container and cause the band to severed along the weakened line.

2. A tamper-indicating package comprising a container, a one-piece molded closure of plastic having a base wall and a peripheral skirt, said skirt having means thereon adapted to interengage securing means on said container, a tamper-indicating band on said closure having a first portion joined to the closure along a weakened frangible line and having an edge spaced from said weakened line, an integral wall joined to the edge by an integral annular connecting portion on said band extending axially toward the base of said closure along the inner surface of said first portion of said band, said wall being joined to said first portion and spaced radially inwardly from said first portion, said wall having a free edge, said wall having circumferentially spaced flexible wall portions along said free edge extending radially inwardly, each said flexible wall portion comprising a pleat which extends radially inwardly from the remainder of the wall from a point intermediate the connecting portion and the free edge and defining an undulating free edge such that when the closure is applied to the container, the circumferentially spaced wall portions flex radially outwardly relative to the remainder of the wall over an annular bead on said container and then radially inwardly beneath the bead on the container, and when the closure is removed, the upper edges of the circumferentially spaced wall portions engage the underside of the bead on the container and cause the band to be severed along the weakened line.

* * * * *